US006139075A

United States Patent [19]

Daoud

[11] Patent Number: 6,139,075

[45] Date of Patent: Oct. 31, 2000

[54] TOOL-OPERATED SLIDING SECURITY SYSTEM

[75] Inventor: Bassel Hage Daoud, Parsippany, N.J.

[73] Assignee: Lucent Technologies Inc., Murray Hill, N.J.

[21] Appl. No.: 09/309,083

[22] Filed: May 10, 1999

[51] Int. Cl.[7] ..... E05C 19/08

[52] U.S. Cl. ..... 292/281; 292/149; 292/301; 292/DIG. 65; 70/465; 70/DIG. 57

[58] Field of Search ..... 292/281, 282, 292/283, 284, 251, 291, 148, 149, 150, 151, DIG. 65, 301; 70/DIG. 57, 465, 164, 159, 229, 232

[56] References Cited

U.S. PATENT DOCUMENTS

| | | | |
|---|---|---|---|
| 1,806,031 | 5/1931 | Vignos . | |
| 1,961,041 | 5/1934 | Gilbert, Jr. | 292/148 |
| 2,825,218 | 3/1958 | O'Brien . | |
| 3,421,350 | 1/1969 | Shanok et al. | 70/455 |
| 3,572,062 | 3/1971 | Beebe | 70/1.5 |
| 3,889,498 | 6/1975 | Harrell | 70/78 |
| 3,926,018 | 12/1975 | Joersz | 70/19 |
| 3,938,837 | 2/1976 | Bright | 292/148 |
| 4,022,037 | 5/1977 | Walters | 70/232 |
| 4,051,790 | 10/1977 | Meditz et al. | 109/58 |
| 4,085,599 | 4/1978 | Fischer et al. | 70/14 |
| 4,159,838 | 7/1979 | Wilzig et al. | 292/150 |
| 4,229,956 | 10/1980 | Thorburn | 70/129 |
| 4,290,281 | 9/1981 | Knaack et al. | 70/54 |
| 4,326,395 | 4/1982 | DeRosa | 70/168 |
| 4,401,247 | 8/1983 | Zoor | 224/315 |
| 4,782,675 | 11/1988 | Thorburn | 70/129 |
| 4,932,692 | 6/1990 | Nelson | 292/148 |
| 5,027,627 | 7/1991 | Derman | 70/164 |
| 5,076,078 | 12/1991 | Weger, Jr. | 70/54 |
| 5,092,143 | 3/1992 | Rumbles | 70/56 |
| 5,312,266 | 5/1994 | Daoud | 439/304 |
| 5,315,849 | 5/1994 | Georgopoulos | 70/34 |
| 5,497,416 | 3/1996 | Butler, III et al. | 379/399 |
| 5,737,948 | 4/1998 | Lefkovits | 70/164 |
| 5,740,685 | 4/1998 | Daoud | 70/164 |
| 5,743,116 | 4/1998 | Suster | 70/14 |
| 5,946,952 | 9/1999 | Mintchenko | 70/2 |

*Primary Examiner*—Anthony Knight
*Assistant Examiner*—Clifford B Vaterlaus
*Attorney, Agent, or Firm*—Stroock & Stroock & Lavan LLP

[57] ABSTRACT

A tool-operated sliding security system for a lockable enclosure comprising a bracket mounted to an outer door of an enclosure, the bracket being movable between an open position and a closed position, the bracket having at least one cutout therein; the outer door having a tool-operated security member mounted thereto, the security member extending through the cutout and moveable between an engaged position and a disengaged position; the outer door also comprising a tool-operated releasable retention member mounted thereto, the retention member releasably maintaining the outer door in a closed position; the bracket being immovable when the security member is in the engaged position and the bracket being movable when the security member is in the disengaged position; wherein the releasable retention member is accessible when the bracket is in the open position thereby rendering the outer door openable.

14 Claims, 4 Drawing Sheets

TOOL-OPERATED SLIDING SECURITY SYSTEM

FIELD OF THE INVENTION

This invention relates to a security system for use with a junction box, a Building Entrance Protector, or any other lockable enclosure or container, and in particular, to a tool-operated sliding security system for permitting access to the enclosure when padlocked, without the need to unlock the padlock.

BACKGROUND OF THE INVENTION

Junction boxes have long been used to collect and protect telephone and electrical wires for distribution, splicing, cross connection and other uses. In the telephony arts, such wire junction boxes are more commonly known as network interface units (NIUs) and/or building entrance protectors (BEPs). Such containers are typically lockable.

In a telephone network, a network cable from the central office is connected to a BEP located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or an SC 99-type connector block, such as are available from Lucent Technologies Inc. The customer telephone equipment is coupled through the connector block to a central office (CO) telephone line. The CO line side of the connector is generally the bottom side of the connector block, where the CO line tip-ring wire pairs are connected using a wire-wrapping tool.

The BEP generally has a lockable outer door to prevent unauthorized access to the components inside. The outer door is generally secured by a keyed or combination type padlock, and the building owner retains possession of the only key (or combination). Frequently, it is necessary for others in addition to the building owner to open the BEP for servicing or maintenance, for example, telephone company technicians or contractors acting in their capacity. Such servicing will at times occur during non-business hours or at other times when the building owner cannot be located or is not available. If the building owner is not available, the technician wishing to service the BEP would not be able to do so because the building owner has the only key to the padlock. The technician would then have to come back at a later date when the building owner was available, which is both inconvenient to the technician, and costly to the building owner and their customers. Also, if the key or combination to the padlock was lost, it would be necessary to saw off the padlock in order to access the components within the BEP. Accordingly, a mechanism for overriding the padlock is desired, while at the same time maintaining the appearance of a secure, locked utility box.

SUMMARY OF THE INVENTION

The present invention provides a tool-operated sliding security system for accessing the components within a padlocked utility box or other enclosure without having to first unlock the padlock, while at the same time maintaining the appearance of a secure, locked utility box. The present invention, while described herein as preferably applied to such boxes as are used in the telephony arts, is, as will be seen from the disclosure herein, applicable to any lockable box, container, enclosure, or door thereof.

The system generally consists of a slideable bracket mounted to the outside of the utility box and comprising a hasp portion at one end thereof. The hasp portion has an opening therein to receive a padlock. The bracket is moveable between an open position and a closed position. The bracket is constructed and positioned such that the hasp portion is mateable with a generally U-shaped fixed hasp which is mounted to the outside of the front door of the utility box. That is, slideable bracket is constructed and positioned such that the hasp portion mates with the fixed hasp to form what appears to be a conventional padlock hasp with an opening to receive a padlock. When the outer door is closed and the slideable bracket is mating with the fixed hasp, a padlock can be inserted through the hasp opening formed thereby in a conventional manner. The fixed hasp is constructed so as to permit the hasp portion of the slideable bracket to be movable within the center portion of the "U" even when the padlock is inserted in the opening in the hasp portion. Thus, when the hasp portion of the slideable bracket is within the center portion of the fixed hasp, and a locked padlock is inserted in the opening of the hasp portion, the slideable bracket remains movable.

The slideable bracket also comprises two cutouts at the end opposite of the hasp portion. In a preferred embodiment, the lower cutout generally comprises a circular opening with a connected channel portion above the circular opening. The circular opening is sized so as to accept the head portion of a threaded security screw which is mounted to the outer door of the utility box, and the channel portion is sized so as to accept the threaded shaft portion of the same security screw. The security screw extends through the bracket and through an opening in the outer door of the enclosure. The opening in the outer door may or may not be threaded. The security screw can be turned or threaded between an engaged position wherein the head portion is within the circular cutout and a disengaged position wherein the head portion is not within the cutout.

The upper cutout of the bracket is generally circular in shape and is positioned on the slideable bracket such that a threaded retention screw, attached to an inside surface of the outer door, is accessible when the bracket is in its open position. In a preferred embodiment, the retention screw extends through an opening in a retention plate which is mounted or otherwise attached to an inside surface of the outer door. The opening in the retention plate may or may not be threaded. The retention screw is affixable or otherwise engageable to an interior wall or surface within the utility box. That is, the retention screw can be turned or threaded to releasably maintain the outer door in a closed position. Thus, the retention screw is operable between an engaged position wherein it engages a threaded opening in, or otherwise attached to, an inside surface or wall of the enclosure, and a disengaged position wherein the retention screw is not engaged with an interior wall or surface within the enclosure. When the retention screw is engaged, the retention screw maintains the outer door in its closed position. Thus, the outer door of the enclosure cannot be opened without first releasing the retention screw. That is, the outer door is not openable even if the padlock is removed.

In a preferred embodiment, the security screw and/or retention screw are specialized screws such as, for example, KS/216 type combination screws or other types of screws known in the art and requiring a special tool to operate. The security screw and/or retention screw may also have locking nuts mounted on a rear side thereof to maintain the security screw and retention screw mounted to the enclosure. Also, the security screw and retention screw can be constructed such that to the untrained eye they appear as merely ordinary screws or bolts serving no apparent hidden purpose. That is, the outer door of the utility box can be constructed with a number of similar or identical looking screws to further maintain the secret function of the security screw and/or retention screw.

In a preferred embodiment, the security screw is visible from outside the utility box, while the retention screw is not visible without first moving the slideable bracket to its open position. When the system is in its closed and locked position, the slideable bracket is in its closed position and the head portion of the security screw is within the lower circular cutout. One of skill in the art will recognize that when the head portion of the security screw is within the lower circular cutout, the slideable bracket is immovable and the outer door of the enclosure cannot be opened. However, the security mechanism can be overridden by the technician or building owner knowledgeable in its construction, facilitating the opening of the outer door without having to first unlock the padlock.

To open the locked enclosure a user first loosens or unthreads the security screw with an appropriate tool such that the head portion is no longer within the circular cutout of the slideable bracket. The slideable bracket is then moveable downward towards its open position wherein the channel portion of the bracket slides around the shaft portion of the security screw. Once the bracket is unthreaded or otherwise moved a sufficient distance, the retention screw becomes visible or otherwise accessible through the upper circular cutout of the slideable bracket. Once the retention screw is accessible, the user unthreads or loosens the retention screw with an appropriate tool a sufficient distance such that it no longer engages the rear or interior wall of the utility box. Once the retention screw is no longer engaged with the interior wall, the outer door can be opened, without having to first unlock the padlock. Thus, while the utility box looks as though it cannot be opened without unlocking the padlock, the technician knowledgeable in its construction can open the utility box without unlocking the padlock.

One of skill in the art will recognize that the shape and positioning of the cutouts and corresponding security screws can be any number of art-recognized shapes without departing from the spirit of the invention as a matter of design choice. Also, while in a preferred embodiment, the security screw and retention screws are described and shown as screws, any. type of securement member will suffice as a matter of design choice. That is, one of skill in the art will recognize that the engagement of the security member to the slideable bracket and the engagement of the retention member to the interior surface of the enclosure can be accomplished in any number of art-recognized ways, such as, for example, by providing keyways, slots, gears or the like without departing from the spirit of the invention.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

Figure 4:
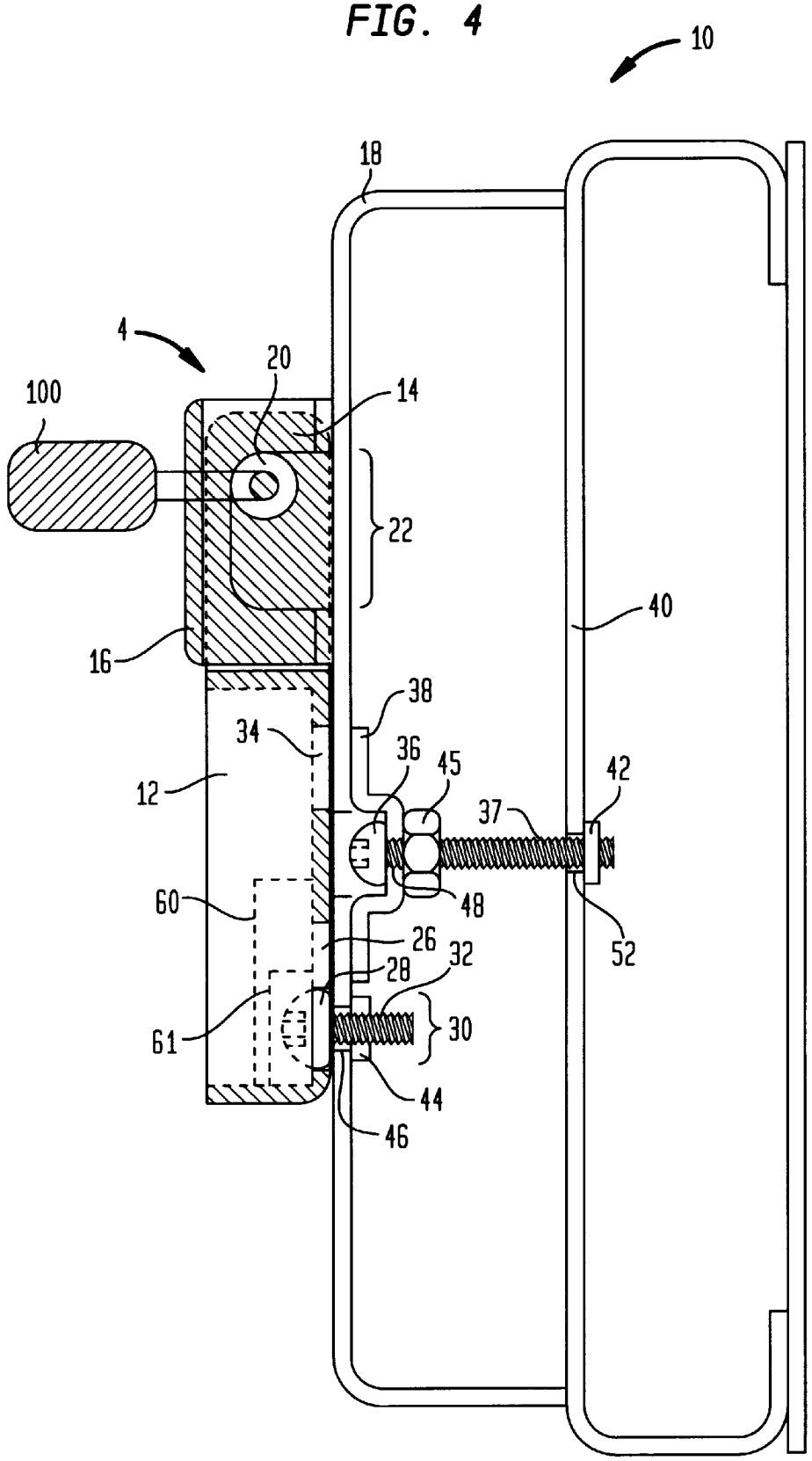
Figure 5:
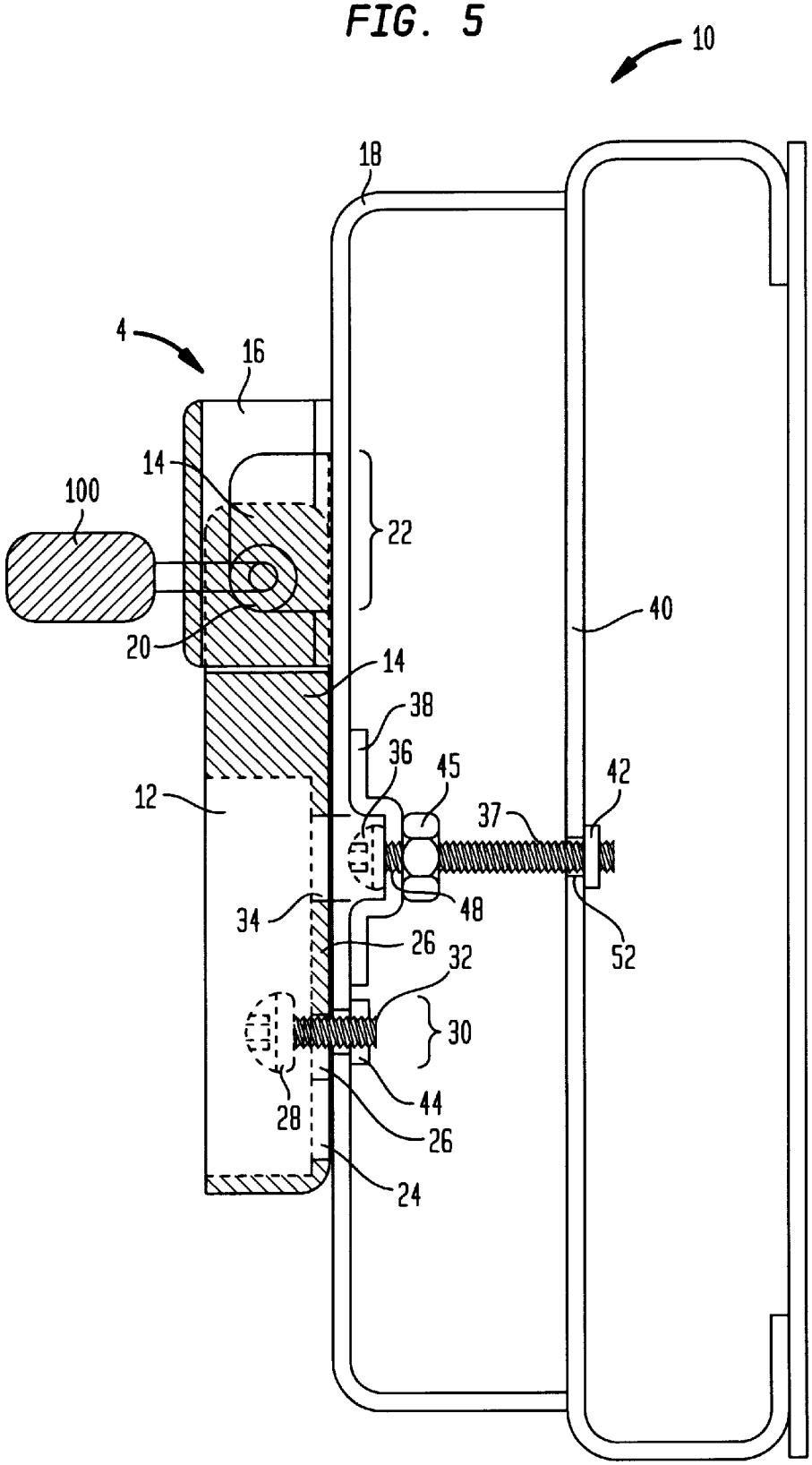

FIG. 4 is a side sectional view of a tool-operated sliding security system constructed in accordance with a preferred embodiment of the present invention mounted to a utility box with the slideable bracket in its closed position and with the padlock rotated upwards approximately 90 degrees for illustration clarity; and FIG. 5 is a side sectional view of the tool-operated sliding security system depicted in FIG. 4 with the slideable bracket in its open position and with the first security screw in its disengaged position and the retention screw is engaged with an interior wall of the utility box.

DETAILED DESCRIPTION OF THE PREFERRED EMBODIMENTS

FIGS. 1 through 5 depict a tool-operated sliding security system constructed according to a preferred embodiment of the present invention. The security system generally includes a slideable bracket, generally indicated as 12, mounted to the outside of the outer door 18 of the enclosure, generally indicated as 10. Slideable bracket 12 comprises a hasp portion, generally indicated as 14, at one end thereof. Hasp portion 14 comprises an opening 20 at one end thereof. Bracket 12 is moveable between a closed position (FIG. 4) and an open position (FIG. 5). The bracket 12 is constructed and positioned such that hasp portion 14 is mateable with a generally U-shaped fixed hasp 16 which is mounted to the outside of the front door 18 of enclosure 10. Bracket 12 is constructed such that hasp portion 14 fits under and within fixed hasp 16 to form a complete hasp, generally indicated at 4. That is, slideable bracket 12 is constructed and positioned such that hasp portion 14 mates with fixed hasp 16 to form what appears to be a conventional padlock hasp.

Figure 1:
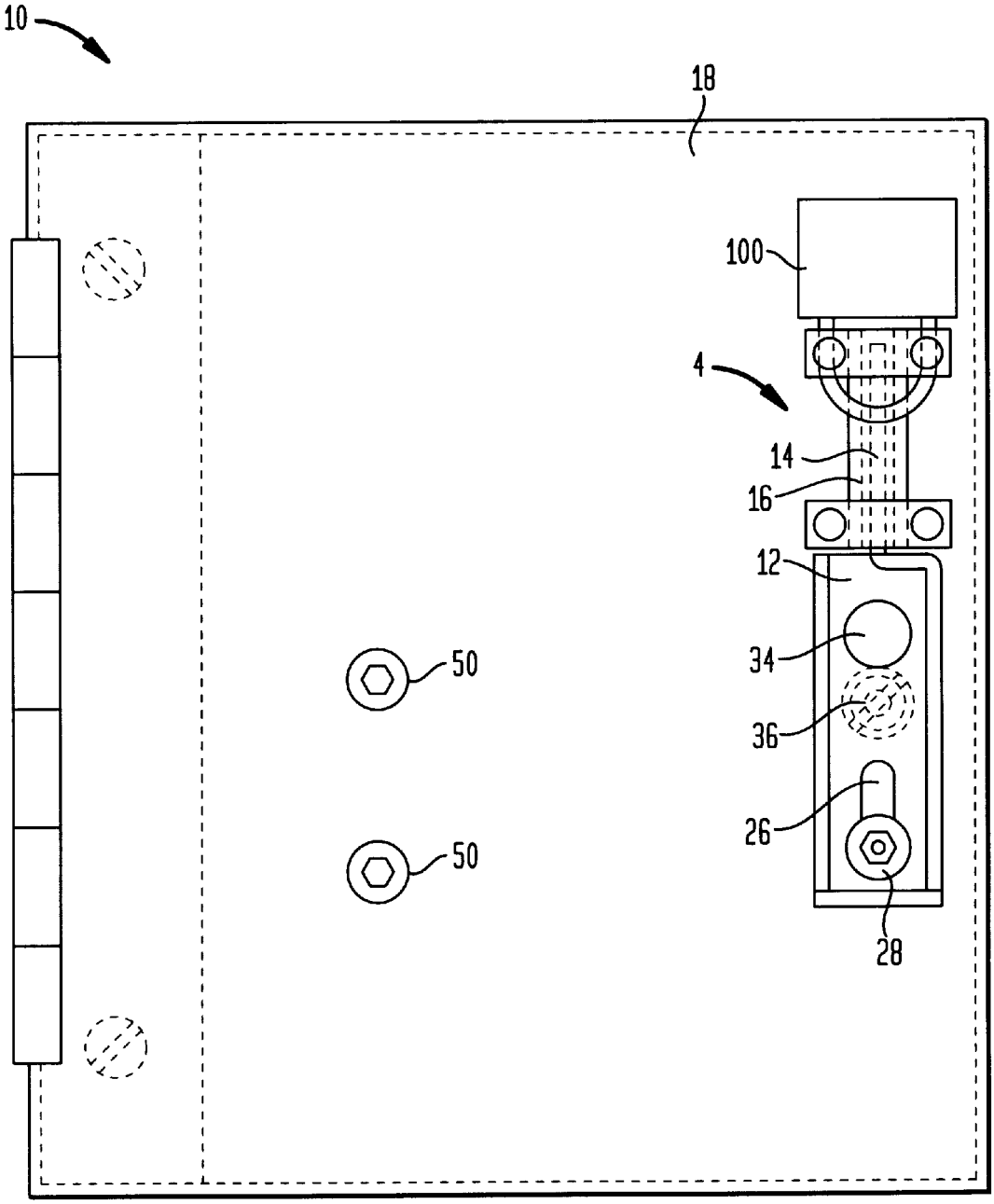
FIG. 1 is a front elevational view of a tool-operated sliding security system constructed in accordance with a preferred embodiment of the present invention mounted to a utility box and with the system in its closed and locked position, wherein the padlock has been rotated upwards for illustration clarity.
Figure 2A:
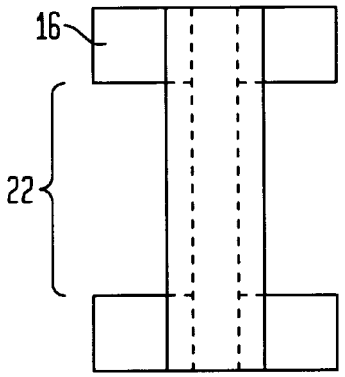
FIG. 2A is a front elevational view of a fixed hasp constructed in accordance with a preferred embodiment of the present invention.
Figure 2B:
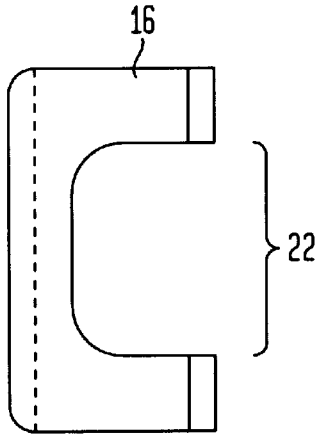
FIG. 2B is a side view of the fixed hasp of FIG. 2A.

As seen in FIG. 1, when outer door 18 is closed and slideable bracket 12 is mating with fixed hasp 16, a padlock 100 can be inserted through opening 20 in hasp portion 14. As seen in FIGS. 2A and 2B, the fixed hasp 16 is constructed so as to permit hasp portion 14 of slideable bracket 12 to be movable within the center portion of the "U", generally indicated as 22, even when padlock 100 is inserted within opening 20 of hasp portion 14. That is, when hasp portion 14 is within or under fixed hasp 16, i.e., within center portion 22, a padlock 100 can be inserted through opening 20 of hasp portion 14. Center portion 22 is sized so as to permit slideable bracket 12 to be movable even when padlock 100 is so inserted. Thus, when hasp portion 14 is within center portion 22, slideable bracket 12 is movable even when the padlock 100 is inserted and locked within opening 20. The fixed hasp, slideable bracket, hasp portion and enclosure can be constructed of any number of materials, such as, by way of a non-limiting example, metal or plastic, or any other material having the necessary rigidity and strength characteristics to perform the functions described herein.

Figure 3A:
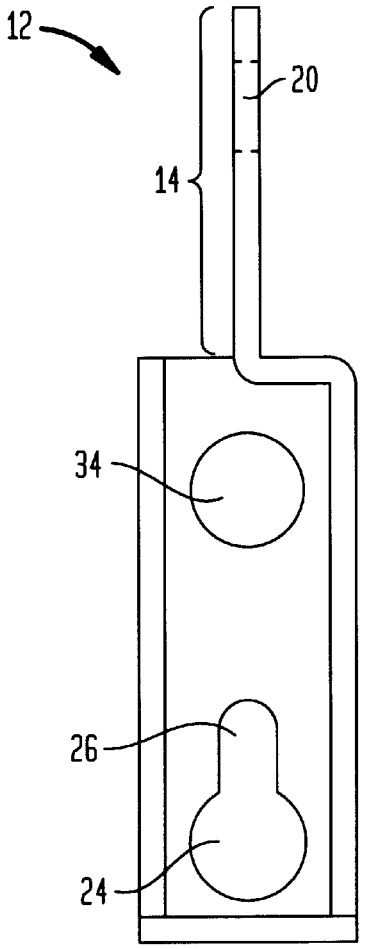
FIG. 3A is a front elevational view of a slideable bracket constructed in accordance with a preferred embodiment of the present invention.
Figure 3B:
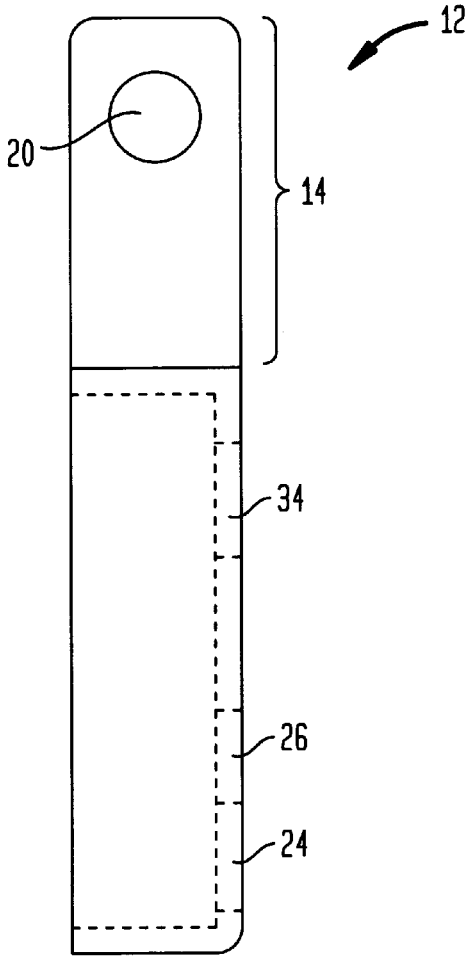
FIG. 3B is a side view of the slideable bracket of FIG. 3A.

As seen in FIGS. 3A and 3B, the slideable bracket 12 also comprises two cutouts at the end opposite of the hasp portion 14. In a preferred embodiment, the lower cutout generally comprises a circular opening 24 with a connected channel portion 26 above and connected to the circular opening 24. Circular opening 24 is sized so as to accept the head portion 28 of a threaded security screw, generally indicated as 30, mounted to outer door 18 of enclosure 10, and channel portion 26 is sized so as to accept the threaded shaft portion 32 of threaded security screw 30. The upper cutout 34 is generally circular in shape and is positioned on slideable bracket 12 such that a threaded retention screw, generally indicated as 36, attached to an inside surface of outer door 18, is accessible when bracket 12 is in its open position.

As seen in FIGS. 4 and 5, security screw 30 extends through circular cutout 24 and through an opening 46 in outer door 18. A nut 44 having a threaded opening therein is installed at an inside surface of outer door 18 to maintain security screw 30 mounted to enclosure 10. Security screw 30 can be turned or threaded between an engaged position (FIG. 4), wherein head portion 28 is within circular cutout 24, and a disengaged position (FIG. 5) wherein head portion 28 is not within circular cutout 24. In a preferred embodiment, retention screw 36 extends through a threaded opening 48 in a retention plate 38 which is mounted or otherwise attached to an inside surface of outer door 18. Retention screw 36 is affixable or otherwise engageable to an interior wall or surface 40 within enclosure 10. That is, retention screw 36 extends through opening 48 in retention plate 38 and through an opening 52 in a rear wall 40 of enclosure 10. A nut 42 is mounted or otherwise attached to a rear side of wall 40 for accepting shaft portion 37 of retention screw 36. A nut 44 is installed on the shaft portion 37 of retention screw 36 at an inside surface of the retention plate 38 for maintaining retention screw 36 to enclosure 10. Retention screw 36 can be turned or threaded between an engaged position, wherein it engages a threaded opening or nut 42 in, or otherwise attached to, an inside surface or wall 40 of the enclosure 10, and a disengaged position wherein the retention screw 36 is not engaged with an interior wall or surface within enclosure 10. When retention screw 36 is engaged, retention screw 36 maintains outer door 18 in its closed position. Thus, outer door 18 of enclosure 10 cannot be opened without first releasing retention screw 36. That is, the outer door is not openable even if the padlock is removed.

In a preferred embodiment, security screw 30 and retention screw 36 are specialized screws such as, for example, KS/216 type combination screws or other types of screws known in the art and requiring a special tool to operate. It will be appreciated to one of skill in the art that security screw 30, retention screw 36, nuts 44 and nut 42 could be constructed in a variety of shapes and sizes to facilitate releasable mating inter-engagement, and for securely retaining bracket 12 in the closed position and outer door 18 in its closed position without departing from the spirit of the invention. Also, security screw 30 and/or retention screw 36 can be constructed such that to the untrained eye they appear as merely ordinary screws or bolts serving no apparent hidden purpose. That is, the outer door of the utility box can be constructed with a number of similar or identical looking screws 50 to further maintain the secret function of security screw 30 and/or retention screw 36.

As seen in FIGS. 4 and 5, in a preferred embodiment, security screw 30 is visible from outside enclosure 10, while retention screw 36 is not be visible without first moving slideable bracket 12 to its open position. One of skill in the art will recognize that the visibility or concealing of the security screw and/or retention screw can be accomplished in any number of ways as a matter of design choice without departing from the spirit of the invention. When the system is in its closed and locked position (FIG. 4), slideable bracket 12 is in its closed position and head portion 28 of security screw 30 is within lower circular cutout 24. One of skill in the art will recognize that when head portion 28 of security screw 30 is within lower circular cutout 24, slideable bracket 12 is rendered immovable and the front door 18 of the enclosure 10 cannot be opened. However, the security mechanism can be overridden by the technician or building owner knowledgeable in its construction, facilitating the opening of the outer door without having to first unlock the padlock.

To open the locked enclosure 10 a user first loosens or unthreads security screw 30 with an appropriate tool such that head portion 28 is no longer within circular cutout 24 of slideable bracket 12 (FIG. 5). Slideable bracket 12 is then moveable downward towards its open position wherein channel portion 26 of bracket 12 slides around shaft portion 32 of security screw 30. Once bracket 12 is moved a sufficient distance, retention screw 36 becomes visible or otherwise accessible within upper circular cutout 34 of slideable bracket 12. Once retention screw 34 is accessible, the user releases or unthreads retention screw 36 with an appropriate tool a sufficient distance such that it no longer engages nut 42 and/or the rear or interior wall 40 of enclosure 10. Once retention screw 36 is no longer engaged with interior wall 40, outer door 18 can be opened without having to first unlock padlock 100. Thus, while the enclosure looks as though it cannot be opened without unlocking the padlock, the technician knowledgeable in its construction can open the utility box without unlocking the padlock. Also, should the key to the padlock become lost, the building owner can open the utility box without having to cut off the padlock.

In an alternate embodiment, as seen in dashed lines in FIG. 4, security screw 30 may be hidden from view by the means of a bumper 60 or other type of movable member. Bumper 60 may be positioned on an outside surface of bracket 12 so as to movably cover or hide security screw 30. Bumper 60 can be bent or otherwise moved so as to reveal security screw 30. Bumper 60 may also extend upwards further to cover or otherwise conceal cutout 34. It will be appreciated to one of skill in the art that bumper 60 could be constructed in a variety of art-recognized shapes and sizes to facilitate movably hiding security screw 30 and/or cutout 34 without departing from the spirit of the invention. In a preferred embodiment bumper 60 is constructed as a removable magnetic label. To the ordinary observer, the bumper would appear to be installed as a means of protecting the enclosure from scratching caused by the insertion and removal of the padlock. The bumper may also be imprinted with text to appear as an advertising or other label for the enclosure manufacturer. One of skill in the art will recognize that bumper 60 can be constructed or positioned as in any number of art-recognized fashions as a matter of design choice for providing a means for concealing the security screw and/or cutout 34 without departing from the spirit of the present invention. For example, the means for concealing the security screw and/or cutout 34 could be a completely removable member, a pivotable member, a swinging member, a screwed on member, a removable magnetic member, or any other device capable of movably concealing the security screw and/or cutout 34. The concealing means could be made of any type of material, such as, by way of a non-limiting example, metal or plastic, or any other material having the necessary rigidity and strength characteristics to perform the functions described herein. The bumper 60 may also comprise a notch 61 on a rear side thereof to accept head portion 28 of security screw 30.

One of skill in the art will recognize that the shape and positioning of the cutouts and corresponding security screws can be any number of art-recognized shapes without departing from the spirit of the invention as a matter of design choice. Also, while in a preferred embodiment, the security screw and retention screws are described and shown as screws, any. type of member will suffice as a matter of design choice. That is, one of skill in the art will recognize that the engagement of the security member to the slideable bracket and the engagement of the retention member to the enclosure can be accomplished in any number of art-recognized ways, such as, for example, by providing keyways, slots, gears or the like without departing from the spirit of the invention.

When the technician has completed servicing of the enclosure, outer door 18 can be closed and re-locked without having to first unlock the padlock. That is, once the technician has completed his work, the technician closes outer door 18, turns retention screw 36 until it engages the interior wall 40, and then moves bracket 12 back to its closed position and engages security screw 30 within cutout 24. Bumper 60, if so provided, can then be repositioned over the security screw and/or cutout 34.

Thus, while the utility box looks as though it cannot be opened without unlocking the padlock, a technician or other user knowledgeable in its construction can open the utility box without first unlocking the padlock. Also, the technician can close the utility box when he is completed without having to first unlock the padlock. Moreover, while the invention set forth herein is generally described in connection with a junction box or other like enclosure, the person of skill will recognize from the teachings herein that the present invention may be applied to any padlocked door, compartment, enclosure or any other structure requiring securement with a padlock and hasp, or the invention may be adapted to a hasp which may mount to a variety of structures.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A tool-operated sliding. security system for a lockable enclosure comprising:

a bracket adapted to be mounted to an outer door of an enclosure, said bracket being movable between an open position and a closed position, said bracket having at least one cutout therein;

a tool-operated security member adapted to be mounted to said outer door, said security member extending through said cutout and moveable between an engaged position and a disengaged position; and a tool-operated releasable retention member adapted to be mounted to said outer door, said retention member adapted to releasably maintain said outer door in a closed position, said bracket being immovable when said security member is in said engaged position and said bracket being movable when said security member is in said disengaged position such that said releasable retention member is accessible when said bracket is in said open position thereby rendering said outer door openable; wherein said bracket further comprises a hasp portion and wherein said system further comprises a fixed hasp adapted to be mounted to said outer door, said hasp portion mating with said fixed hasp for forming a padlock receiving portion.

2. The security system according to claim 1, wherein said security member comprises a KS/216 type combination screw.

3. The security system according to claim 1, wherein said retention member comprises a KS/216 type combination screw.

4. The security system according to claim 1, wherein said retention member is accessible through a second cutout in said bracket.

5. The security system according to claim 1, wherein said retention member is accessible through a second cutout in said bracket and said second cutout is positioned between said first cutout and said hasp portion.

6. The security system according to claim 1, further comprising means for concealing said security member from outside said enclosure.

7. The security system of claim 6, wherein said concealing means is movable to reveal said security member.

8. The security system of claim 6, wherein said concealing means is removable.

9. The security system of claim 6, wherein said concealing means is a magnetic label.

10. The security system according to claim 1, wherein said retention member is adapted to engage an interior portion of said enclosure.

11. The security system according to claim 1, wherein said retention member is adapted to engage a threaded opening adapted to be attached to an interior surface of said enclosure.

12. The security system according to claim 1, wherein said security member is adapted to extend through an opening in said outer door.

13. The security system according to claim 1, wherein said fixed hasp is generally U-shaped and said hasp portion mates beneath and within said fixed hasp such that a locked padlock cannot be removed from said padlock receiving portion without first unlocking the padlock.

14. The security system according to claim 1, wherein said system is adapted to be mounted to a Building Entrance Protector.

* * * * *